United States Patent [19]

Szabo

[11] 4,277,888

[45] Jul. 14, 1981

[54] KNIFE

[76] Inventor: Stephan L. Szabo, Peteracherstrasse 2, CH-8126 Zumikon, Switzerland

[21] Appl. No.: 151,871

[22] Filed: May 21, 1980

[30] Foreign Application Priority Data

May 25, 1979 [CH] Switzerland ..... 4875/79

[51] Int. Cl.[3] ..... B26B 29/00

[52] U.S. Cl. ..... 30/162; 30/40

[58] Field of Search ..... 30/162, 40, 40.2

[56] References Cited

U.S. PATENT DOCUMENTS

| | | | |
|---|---|---|---|
| 1,823,708 | 9/1931 | Straus | 30/40 |
| 2,172,072 | 9/1939 | Rothschild | 30/162 |
| 3,137,940 | 6/1964 | Curci | 30/40 |
| 3,660,896 | 5/1972 | Umholtz | 30/162 |
| 4,005,525 | 2/1977 | Gringer | 30/162 X |

FOREIGN PATENT DOCUMENTS

| | | | |
|---|---|---|---|
| 61541 | 1/1975 | Australia | 30/162 |
| 2827381 | 8/1979 | Fed. Rep. of Germany | 30/162 |

*Primary Examiner*—Jimmy C. Peters

*Attorney, Agent, or Firm*—Watson, Cole, Grindle & Watson

[57] ABSTRACT

The knife with an extensible and retractable blade has a hollow knife grip and a blade magazine with a plurality of superposed blades therein. With the aid of two entraining members in the form of a pusher bar and two gripper arms of a blade-changing device which slides with the entraining members along two sides of the blade magazine, on pulling the blade-changing device out of the knife grip a used blade is guided by gripper arms back into the blade magazine and on pushing the blade-changing device back into the knife grip, the new blade is pushed out from the blade magazine by means of the pusher bar in the direction towards the front end of the knife and into engagement with a blade-pusher. The blade pusher has a pin arranged at the end of an arm which engages in a hole in the blade. Then with the aid of the blade pusher the blade may be extended to a greater or lesser extent from the knife grip or may be fully retracted into it and arrested in various stop or detent positions.

12 Claims, 21 Drawing Figures

XI
153
113
151
150
155
157
156
161
139
126
125
135
119
118
145
136
116
112
120
111
21
130
132
138
114
133
134
131
147
142
148
115
141
146
144

KNIFE

The invention concerns a knife with a blade pusher reciprocable relative to a knife handle and arrestable in stop or detent positions by means of which a blade can be extended from and retractable into a guide slit at the front end of the knife handle or grip, and a blade magazine arranged in the knife grip with a supply of blades contained therein.

Knives of the above-mentioned type are known and are used for manual work requiring a very sharp cut, such as for instance in cutting fitted carpets or similar work, wherein the edge becomes blunt relatively quickly so that the blade has to be exchanged for a new one. When the knife is not being used, the blade must be fully retractable into the knife handle to exclude all risk of injury from the very sharp blade.

In simple knives of this type when a blade is to be exchanged a new blade must be taken from a package and inserted into the knife handle while the removed and no longer usable blade must be carefully packed away in order to exclude the danger of injury from the cutting edge that is still sharp.

In various known embodiments of such knives, the strip-like blades have prestamped lines of breakage at a uniform spacing so as to enable the front blade which has become no longer usable to be broken off along the lines of break whereby again a sharp blade section forms the front end. Such knives thus have a supply of blades in the knife handle but the danger of injury is still present both on breaking the front blade section off and when a used blade that has not been packed away is lying around and in each case hands must be used for effecting a blade change.

From U.S. Pat. No. 2,172,072 a knife of this type is known wherein an accurately dimensioned interior space of the knife handle contains a supply of four blades.

From this supply of blades one blade may be pushed forwardly at a time, however, it cannot be passed back into the same position. A blade that has become unusable must be taken out at the front end. On removal of a used blade, as well as on the insertion of four new blades into the knife handle, the blades have to be handled and thus the risk of injury cannot be obviated. The new blades must first be taken from a package in order to fill the knife handle with four new blades, so that this dispenser of four blades does not make work appreciably easier.

The underlying task of the present invention is therefore to obviate all risk of injury in a knife of the above-described type so that neither on insertion of a supply of blades into the knife handle, nor on exchanging a blade that has become unusable against a new blade, do hands come into contact with the blades, and moreover blades which have become unusable remain securely in the knife handle until all the blades of a supply, which is as large as possible, preferably 20 blades, become unusable. Such a knife not only affords optimum security against the danger of injury but also allows a considerably more expeditious manner of working with such a supply of blades.

To solve this task the knife according to the invention is characterised in that the knife handle contains a blade-changing device which is reciprocable relative to the blade magazine and knife handle, the end of the blade-changing device projecting out from the knife handle and being constructed as a hilt for displacement, and that the blade-changing device has first and second entraining members lying against respective sides of the blade magazine, the first entraining member being effective to retract a used blade from the guide slit of the knife handle into the blade magazine and the second entraining member being effective to push a new blade from the blade magazine forward into a position wherein it is engageable by the blade pusher in order to be pushed into the guide slit of the knife grip.

Details and advantages of the invention will become clear from the description and the drawings, wherein FIGS. 1 to 10 show a first preferred embodiment and FIGS. 11 to 21 a second preferred embodiment of the invention, and wherein:

Figures 1, 2, 3, 4, 5:
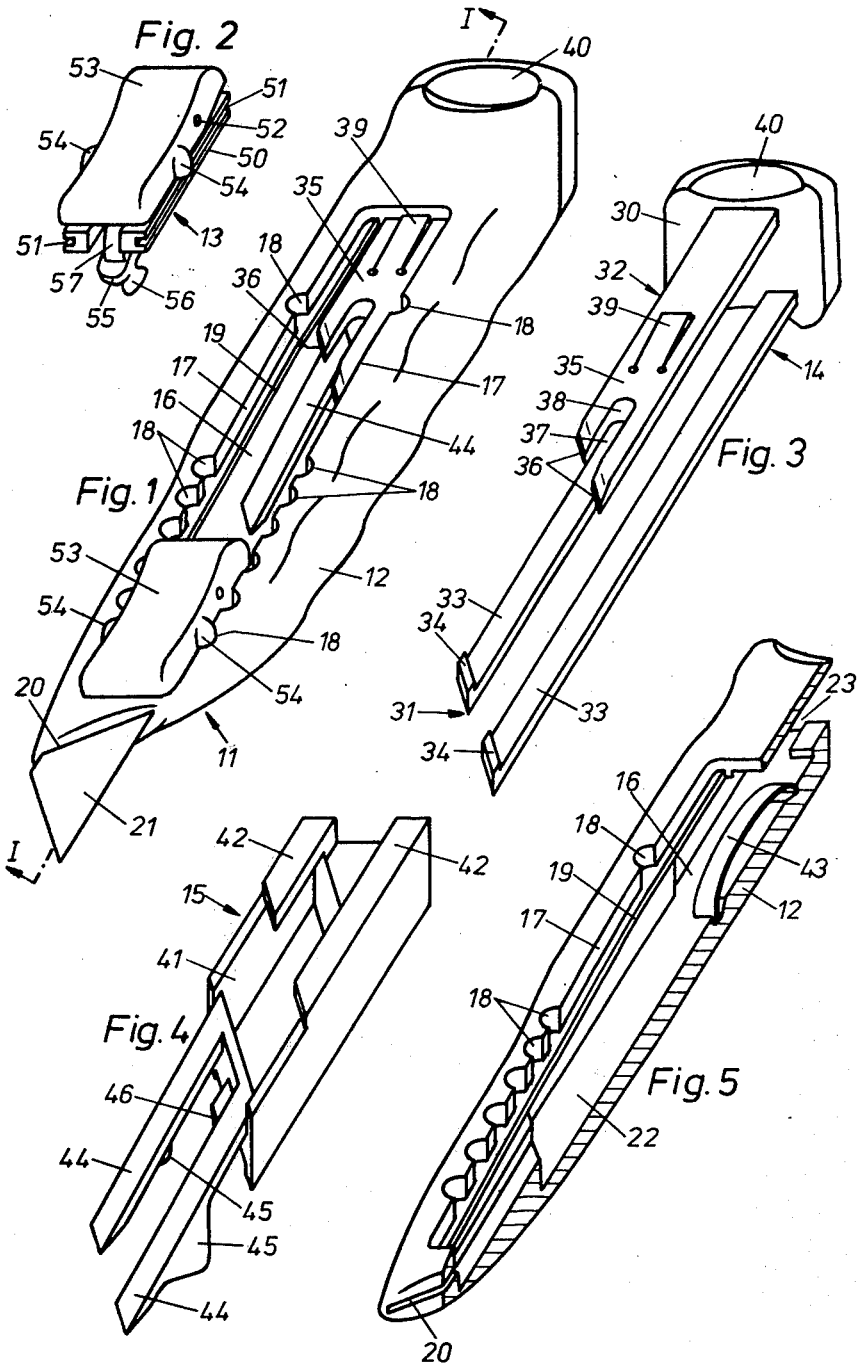
FIG. 1 is a perspective view of a first embodiment of the knife.
FIG. 2 is a perspective view of the blade pusher of the knife according to FIG. 1.
FIG. 3 is a perspective view of the blade-changing device of the knife according to FIG. 1.
FIG. 4 is a perspective view of the blade magazine of the knife according to FIG. 1.
FIG. 5 is a longitudinal section through the knife grip along the line I—I of FIG. 1.

The knife 11 illustrated in perspective view in FIG. 1 has four main components, viz, a knife handle or grip 12, made of a one-piece plastics part, the blade pusher 13 illustrated in FIG. 2, and which is guided for reciprocation in the knife grip, the blade-changing device 14 illustrated in FIG. 3 which is guided in the knife-grip 12 and which can to a limited extent be pulled out from the knife grip and pushed back into it again, and the blade magazine 15 illustrated in FIG. 4 which is stationarily arranged in the blade grip 12 and serves for receiving a number of blades not shown in FIG. 4. The knife grip 12, the blade-changing device 14 and the blade magazine 15 respectively consist of plastics parts manufactured from a single piece while the blade pusher 13 is assembled from a plurality of plastics parts.

The knife grip 12 illustrated in perspective in FIGS. 1 and 5 has at one side thereof a longitudinally extending wide slot 16 opposite edges 17 of which are formed with a plurality of detent or stop recesses 18. Guide strips 19 extend beneath the edges 17 of the slot and the blade pusher 13 according to FIG. 2 is guided on these strips. At its front end, the knife grip 12 is provided with a guiding slit 20 for a blade 21 that is being used and which partially projects from the knife grip. A hollow space 22 within the knife grip 12 connected to the guiding slit 20 contains the blade magazine 15 and the blade-changing device 14, this hollow space 22 being open to the outside of the knife via the longitudinal slot 16. The blade magazine 15 and the blade-changing device 14 may be pushed into the knife-grip 12 by an opening 23 at the rear end of the knife grip 12.

The blade-changing device 14 according to FIG. 3 has a knob 30 serving as a hilt and a first entraining member 31 associated with a shorter and parallel second entraining member 32 which extend, spaced above each other, from the same side of the knob 30. The first entraining member 31 consists of two flat parallel gripper arms 33 the free ends of which have a respective upstanding edge 34 serving to retract a used blade lying on the gripper arms 33 into the blade magazine 15 when the blade-changing device 14 is pulled out from the knife grip 12.

The second entraining member 32 of the blade-changing device 14 consists of a flat strip 35 arranged in parallel with the first entraining member and which has at its front end a feeding or forwardly pushing edge 36 by means of which a new blade is pushed forwardly out from the magazine 15 when the blade-changing device 14 is pushed back into the knife grip 12 again. The front end of the pushing strip or bar 35 further includes a slit 37 by means of which the end of the bar is formed as a fork. The configuration of this slit 37 forms an oblique edge 38 against which the blade pusher 13 abuts, as will be described in greater detail below. At the upper side of the pushing bar 35 a resilient tongue 39 is formed which projects somewhat from the plane of the pushing bar 35 and serves as a lock to block the blade-changing device 14 pushed into the knife grip 12 and, as may be seen in FIG. 1, bears against the edge at the end of the slot 16 in the knife grip 12 so that when the tongue 39 is upstanding the blade-changing device 14 cannot be pulled out from the knife handle. The upstanding tongue 39 is pushed down by the blade pusher 13 according to FIG. 2 when the latter is pushed back to the end of the slot 16 in the knife grip 12 and is located in a detent position since only in this end position of the blade pusher 13 is a used blade fully retracted from the guiding slit 20 in the knife grip 12 and laid on the gripper arms 13 of the blade-changing device 14, so that on actuation of the blade-changing device 14 by pulling it out and then pushing it back in again a correct blade-change may take place. In a position of the blade pusher 13 further forward in the slot 16 in the knife grip 12 this could not be the case and therefore in any other position of the blade pusher except its position at the end of the slot 16 the blade-changing device 14 is necessarily blocked.

The knob 30 of the blade-changing device 14 serving as a hilt has a recess 40 at the top and at the bottom in order to facilitate the gripping of the blade-changing device with the thumb and fingers.

The blade magazine 15 illustrated in FIG. 4 consists essentially of an open box 41 formed of two mutually opposite sides and having a shape in plan view corresponding to the shape of the blades 21. A stack of mutually superposed blades, not illustrated in FIG. 4, are disposed in this box. The two entraining members 31 and 32 of the blade-changing device 14 slide along the two open sides of the box 41. Additionally, the box has two mutually opposed abutment bars at the upper (as seen in FIG. 4) open side which abutment bars project somewhat inwardly over the stack of blades and serve as abutments for the blades that are being pressed upwardly from the bottom of the box. The upward pressure on the stack of blades against the abutment bars 42 is exerted by a leaf-spring 43 arranged internally of the knife grip 12, which spring may be seen in FIG. 5. In this way, the entraining member 32 of the blade changing device 14 guided between the two abutment bars 42 always engages the blade lying uppermost in the stack.

Two support rails 44 are arranged at the narrow side of the box 41 facing the front end of the knife grip 12 with the guiding slit 20 and a blade pushed forwardly out of the blade magazine by the pusher edge 36 of the feed bar 35 slides along these rails in order then to be caught by the blade pusher 13, as will be explained in greater detail below. Downwardly projecting webs or lugs 45 are disposed on the underside of these support rails 44 and have the task of pressing down a used blade that has been retracted from the guiding slit 20 of the knife grip 12 against the gripper arms 33 of the blade-changing device 14, whereby to ensure that the blade cannot freely move about within the knife grip during the process of exchanging blades. On the same side of the box 41 of the blade magazine 15 there is provided an oblique entry edge 46 formed by another downward projection which steers the used blade on actuation of the blade-changing device 14 to the underside of the blade magazine 15.

The blade pusher 13 illustrated in perspective view in FIG. 2 has a sliding body 50 provided with a respective longitudinal slit 51 on opposite sides with the aid of which the sliding body 50 is guided on the guiding bars 19 within the slot 16 of the knife grip 12. A rocker 53 is journalled by means of an axle or shaft 52 on the sliding body 50. The rocker has lugs 54 on opposite sides thereof with which the rocker 53 locate in the detent recesses 18 formed on mutually opposite edges 17 of the slot 16. The detent recesses 18 forming respective rows at the front part of the knife serve to locate the blade pusher 13 and thus the blade 21 in more or less extended positions and to locate the blade 21 in the fully retracted position while the single pair of stop recesses 18 present in the rear part of the knife grip 12 blocks the blade pusher 13 in a position wherein the resilient tongue 39 in the second entraining member 32 is pressed downwardly by the sliding body 50 of the blade-pusher 13 and an exchange of blades can be effected by actuation of the blade-changing device 14. The blade pusher 13 furthermore includes an arm 55 pivotally connected to the underside of the sliding body 50, the free end of the arm having a pin or dog 56 meshing with a blade in order to reciprocate it relative to the knife grip 12. To this end, the arm 55 is pressed downardly by a leaf-spring 57 arranged between the arm and the sliding body 50.

Figure 6:
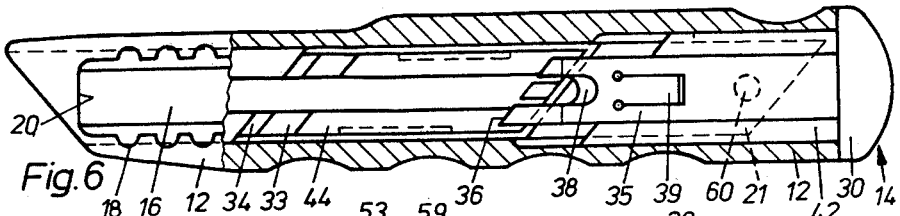
FIG. 6 is a longitudinal section through the knife without the blade pusher along the line II—II of FIG. 7.

The co-operation of the components of the knife during the process of exchange of blades may be better explained by reference to FIGS. 6 to 10 wherein the above-described components are illustrated in different positions during the exchange of blades. In FIG. 6 there is shown a plan view of a partly sectioned knife with the uppermost blade 21 of the stack of blades being shown in broken lines and it may be seen that the blade having the shape of an inclined acuteangled parallelogram has a hole 60 into which the pin 56 on the arm 55 of the blade-pusher 13 engages, as may be seen in FIG. 7. From FIG. 7 it may also be deduced that the arm 55 of the blade pusher 13 is pivotally journalled by means of a pivot shaft at the sliding body 50, and that the angled end 59 of the spring 57 presses against the underside of the rocker 53, so that the rocker 53 must be pressed down against the bias of the spring in order that it may be released from its detent position and the blade pusher 13 may be pushed along the knife grip.

Figure 7:
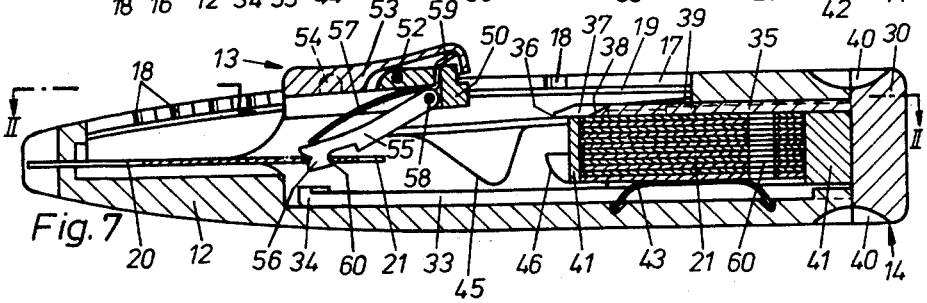
FIGS. 7 to 10 are longitudinal sections through the knife along the line I—I in FIG. 1 at various positions of the blade-pusher and the blade-changing device.

In FIG. 7 a position of the blade pusher 13 is shown wherein the pin 56 at the end of the arm 55, which is secured pivotally on the blade pusher 13, engages in the hole 60 of the blade 21 so that the blade is coupled with the blade pusher 13 and can be pushed forwardly out of the guiding slit 20 in the knife grip or also may be pushed further back into the blade grip when the blade is to be exchanged against a new one from the magazine.

Figure 8:
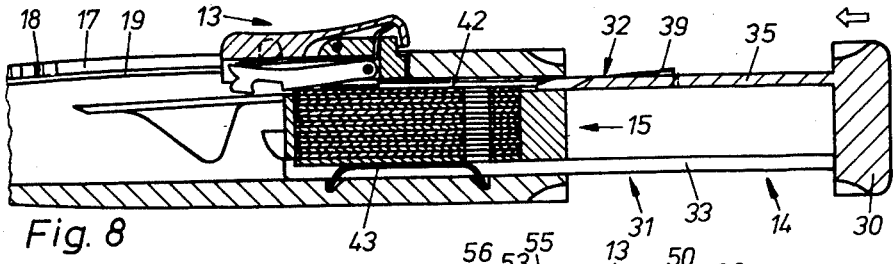
Figure 9:
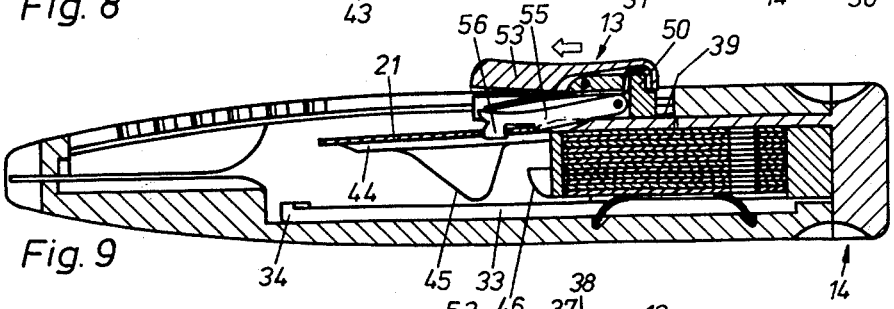

The position of the parts during the performance of a blade exchange is explained in FIG. 8. For this purpose, the blade pusher 13 is pushed into its rearmost detent position in which the resilient tongue 39 on the upper side of the feed bar 35 of the blade-changing device 14 is pressed down by the sliding body 50 of the blade pusher, so that the blade-changing device 14 can be pulled out from the knife grip 12. FIG. 8 also shows that the spring 43 arranged on the interior of the knife grip 12 presses the stack of blades 21 upwardly against the abutment bars 42 of the blade magazine 15 so that the bar 35 of the blade-changing device 14, which lies at a depth lower by the thickness of a blade and is guided between the abutment bars, is disposed with its pusher edge 36 behind the uppermost blade in the stack, so that this uppermost blade may be pushed forwardly out of the blade magazine, during which movement this blade lies against the support rails arranged at the sides of the blade magazine and thus comes into entraining engagement with the blade pusher 13, wherein the pin 56 on the arm 55 of the blade pusher 13 engages into the hole 60 of the blade 21, as may be seen in FIG. 9, wherein a position is shown in which the blade-changing device 14 is again pushed into the knife grip and the blade pusher 13 is pushed somewhat forwardly of its end position.

Figure 10:
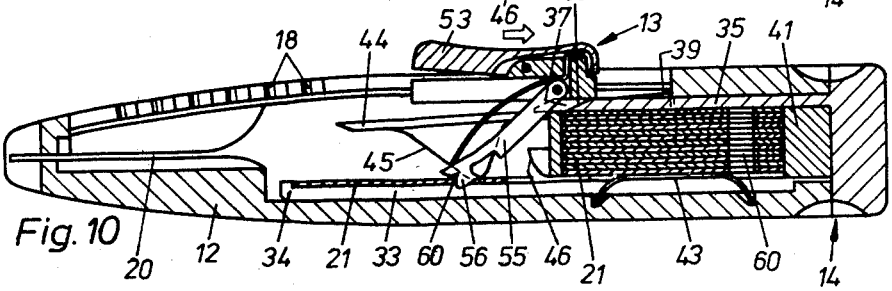

When a used blade is to be exchanged for a new blade, the position shown in FIG. 8 is reached, the blade pusher 13 having previously been pushed into its rearmost detent position, as may be seen in FIG. 10. In that way, the blade pusher 13 coupled with the blade pulls the latter out of the guiding slit 20 in the knife grip in a rearward direction so that next the blade comes to lie on the two gripper arms 33 of the blade-changing device 14. The arm 55 of the blade pusher 13 which is subject to the bias of the spring 57 guides the blade downwardly onto the two gripper arms and under the two lugs 45 which are arranged on the underside of the two support rails 44.

On further retraction of the blade pusher 13 into the rear rest position, the arm 55 abuts against the inclined edge 38 at the end of the slit 37 in the fork-shaped end of the bar 35 of the blade-changing device 14, so that the arm 55 is pivoted thereby, against the bias of the spring 57, and the pin 56 can leave the hole 60 in the blade 21. In this position of the blade pusher the webs or lugs 45 prevent the blade lying on the gripper arms 33 from freely falling about in the knife grip. The upstanding edges 34 at the ends of the gripper arms 33 then entrain the blade when the blade-changing device is pulled out of the knife grip in order to guide the used blade back into the blade magazine 15, the oblique entry edge 46 on the outer edge of the blade magazine ensures that the blade passes in the correct orientation to the lower open side of the blade magazine where it is pulled in between the spring 43 and the lowermost blade in the stack. When the used blade is guided back into the blade magazine, the FIG. 8 position is reached so that next a new blade may be pushed forwardly out of the magazine from the upper side of the stack of blades.

The blade magazine 15 may accommodate, according to the thickness of the blades, up to 20 such blades which can be used one after the other. A particular advantage consists in that the blade does not need to be handled during the exchange so that in this regard the knife affords optimum safety. The supply of blades is in addition always kept together and need not first be removed from a package first. Since all main components of the knife consist of plastics materials, the knife can be very inexpensively manufactured and may after using up all the blades be thrown away so that the blades present no danger of accident, even after use.

A different embodiment of the knife 111 according to FIGS. 11 to 22 has a replaceable blade magazine 115 in a knife grip 112 made of plastics material. The difference between the first embodiment of the knife 111 according to FIGS. 1 to 12, wherein the blade magazine is fixedly secured in the knife grip 12 and wherein after all blades become unusable the whole knife with the blade magazine is to be thrown away, and the second embodiment of the knife 111 resides in that the blade magazine 115 simultaneously serves as the dispatch or travelling packing for the blades which is to be pushed into the knife grip at the rear end thereof and which, after all blades become unusable, is removed again in order to be exchanged for a new blade magazine.

Figures 11, 12, 13, 14, 15:
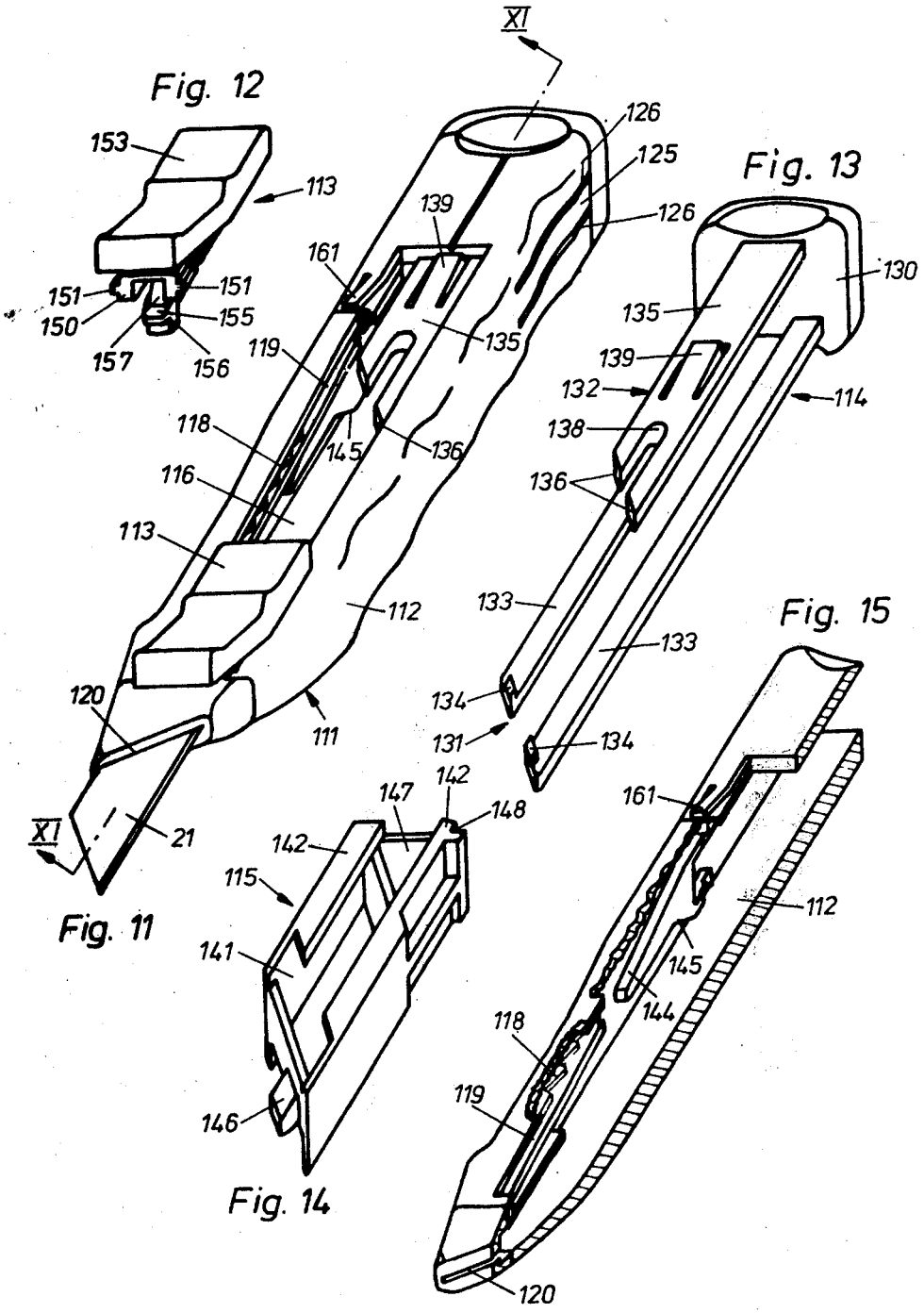
FIG. 11 is a perspective view of a second preferred embodiment of the knife.
FIG. 12 is a perspective view of the blade pusher of the knife according to FIG. 11.
FIG. 13 is the blade-changing device of the knife according to FIG. 11 in perspective view.
FIG. 14 is a perspective view of the blade magazine of the knife according to FIG. 11.
FIG. 15 is a longitudinal section through the knife grip along the line XI—XI in FIG. 11.

The constructional variant of the knife 111 also consists of four main components, namely the knife grip or casing 112 consisting of plastics material, the blade pusher 113 shown in FIG. 12 which is guided in the knife grip and is reciprocable, the blade-changing device 114 illustrated in FIG. 13 as well as the blade magazine 115 illustrated in FIG. 14 which serves to receive a plurality of blades not shown in FIG. 14. Preferably 20 blades are contained in the blade magazine.

To ensure that the blade magazine 115 may simultaneously serve as a dispatch container, this magazine is constructed differently from the first embodiment of the blade magazine according to FIG. 4. The blade magazine 115 has no support rails at its front narrow side along which the blade to be pushed forwardly may slide. Instead, in the knife 111 according to FIG. 11 corresponding support rails 144 are rigidly arranged on the inside of the knife grip 112. Further, the webs or lugs arranged on the underside of the support rails 44 of the first embodiment of the blade magazine 15 are in the form of guiding ledges 145 on the internal side of the knife grip 112. A straight guiding rail 144 and a guiding ledge 145 starting from the guiding rail and bent downwardly therefrom, are together shaped when seen in side view, as a rail point and are moulded on the opposite internal sides of the knife grip 112 and take over the function of guiding the blade during pushing out and pushing back into the blade magazine.

In other respects the blade magazine 115 according to FIG. 4 consists, in conformity with the blade magazine 15 according to FIG. 4, of an open box 141 having two mutually opposite sides with two abutment bars 142 at the upper open side which serve as abutments for the blades pressed upwardly from the bottom of the box.

As is evident from FIGS. 17 to 20, a further difference consists in that a leaf spring 143 with its bent end is anchored in a hollow space 147 at the rear end of the blade magazine 115 and the portion of this spring extending along the underside of the blade magazine presses the blades upwardly against the abutment bars 142. The blade magazine 115 is sold together with the blades and the spring holding the blades stationary in the magazine in one package, so that a magazine with blades which have become unusable may simply be exchanged for a new magazine and thus the individual blades need not be handled and so no risk of injury arises. In this embodiment also a particular feature of this knife consists in that the new and used blades circulate within the knife until all blades in the magazine becomes unusable, and the magazine is to be exchanged.

Figure 16:
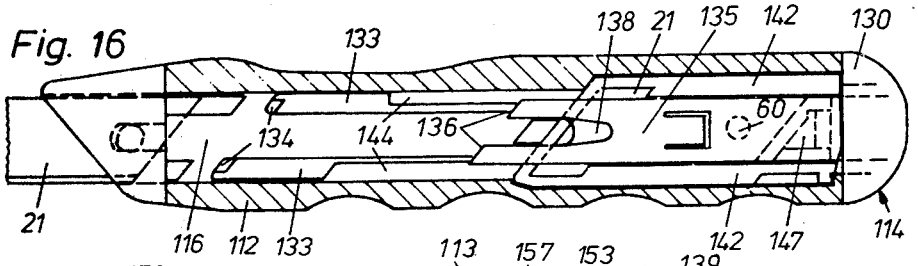
FIG. 16 is a longitudinal section through the knife without the blade pusher along the line XII—XII of FIG. 17.
Figure 17:
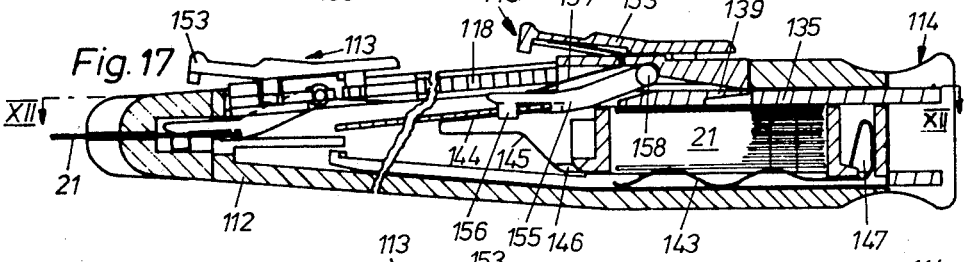
FIGS. 17 to 20 are longitudinal sections through the knife along the line XI—XI in FIG. 11, in different positions of the blade pusher and of the blade-changing device.
Figure 21:
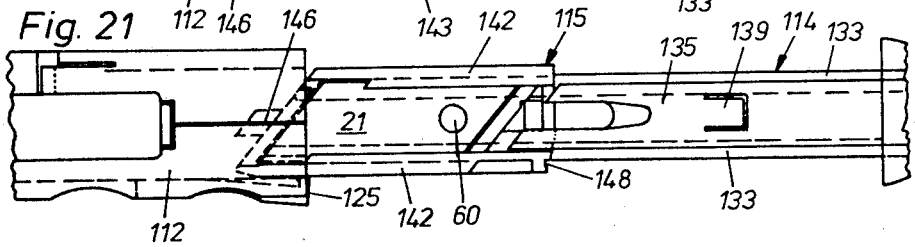
FIG. 21 is a plan view on the end of the knife grip with the blade-changing device and the blade magazine pulled out.

As may be seen from FIGS. 16, 21 and 22 the blade magazine 115 is held stationary at the rear end of the knife grip 112 by a somewhat resilient latch 125 which latch is constituted by a tongue-shaped wall part of the knife grip formed by two slits 126 in the knife grip, this end snapping inwardly over the edge of the blade magazine 115 whereby the blade magazine is rigidly held in the knife grip. The latch 125 engages in a corresponding recess 148 at the outer end edge of the blade magazine 115.

A further difference between the first and second embodiments of the knife resides in that the blade pusher 113 of the knife 111 is constructed differently from the blade pusher 13 of the knife 11 and, further, the lugs which cannot be seen in FIGS. 11 to 21 co-operate in a different way with the detent recesses 118 and the opposite edges of the slot 116 in the knife grip 112. At the two sides of the slot 116 in the knife grip 112 a respective longitudinal groove 119 is formed and in the groove uniformly spaced teeth-like recesses 118 are formed as detent into which parts of the blade pusher not shown in the drawing snap in. From FIG. 12 it may be seen that the blade pusher 113 has a sliding body 150 two longitudinal sides of which have ledges 151 with the aid of which the blade pusher 113 is guided in the groove 119 of the knife grip 112. In conformity with the first embodiment the blade pusher 113 also has an arm 155 pivotally journalled by means of a pivot shaft 158 at the sliding body 150. The free end of the arm has a pin 156 which comes into engagement with the hole 60 in a blade 21 to push the blade back and forth relative to the knife grip. The arm 155 is loaded by a spring 157 whereby the pin 156 automatically engages in the hole 60 of the blade 21. In deviation from the first embodiment the end of this spring 157 is so angled that it presses the front end of the rocker 153 of the blade pusher 113 upwardly. Accordingly, the rocker 153 must be pressed down at its front end against the bias of this spring in order to release the detent means not shown in the drawing but present at the rear end of the blade pusher from the detent recesses 118 at the knife grip. Thus the rocker 153 of the blade pusher 113 is to be actuated differently from the actuation of the rocker 53 of the blade pusher 13 of the first preferred embodiment of the knife. In other respects there is no difference in the mode of functioning of the blade pushers 13 and 113 with regard to the co-operation of the pivotable arm 155 with the blade-changing device 114 when a used blade is to be guided back into the blade magazine.

The blade-changing device 114 according to FIG. 13 and the blade-changing device 14 according to FIG. 3 are constructed identically and their function is also similar. The reference numbers are differentiated as regards the corresponding parts by the prefixed numeral 1 (an increase of 100). Accordingly, the blade-changing device 114 has a knob 130 at which are secured a first entraining member 131 and a second entraining member 132. The first entraining member consists of two parallel gripper arms 133, each with an upstanding edge 134 at the end and the second entraining member 132 consists of a flat bar 135 which at its end has a feeding or pushing edge 136 and is constructed as a fork, and further it has an oblique edge 138 for co-operation with the arm 155 of the blade pusher 113. A resilient tongue 139 at the upper side of the bar 135 serves as a lock for blocking the blade-changing device 114 in the knife grip 112. At the right-hand side of FIG. 17 it may be seen that this resilient tongue 139 is pressed down by the blade pusher 113 when the latter is in its rearmost position in the slit 116 of the knife grip 112. From that same FIG. 17 on the left-hand side the front-most position of the blade pusher 113 may be seen with a blade pushed out or extended from the knife grip.

Figure 18:
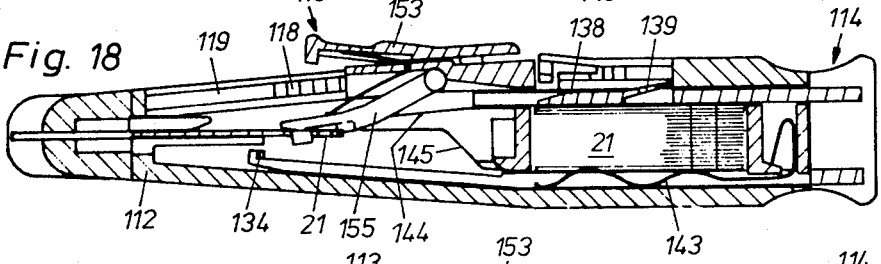
Figure 19:
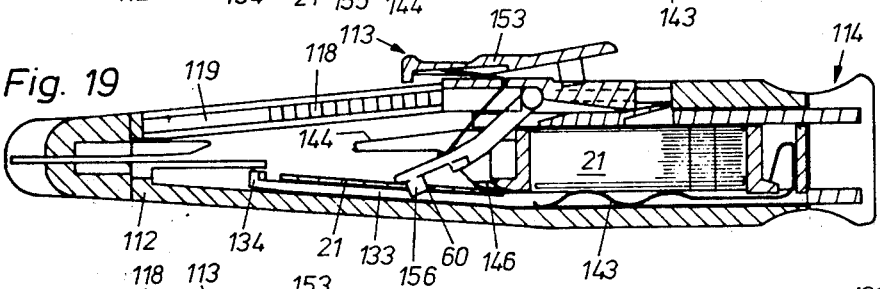
Figure 20:
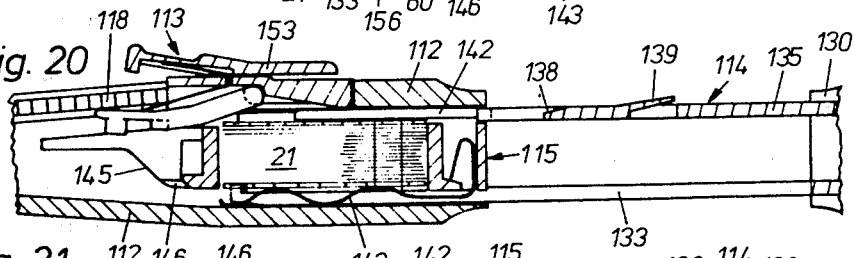

From FIg. 18 it may be seen how a blade 21 is guided on retraction of the blade pusher 113 by means of the arm 115 subjected to spring pressure into the space beneath the guiding rails 144, whereafter the blade 21 is laid on the gripper arms 133 of the blade-changing device 114, according to FIG. 19. Then, according to FIG. 20, the blade-changing device 114 is rearwardly pulled out from the knife grip 112 after first the pin 156 at the end of the pivotable arm 155 has been released from the hole 60 in the blade 21. The upward pivoting of the arm 155 necessary therefor ensues through the abutment of the arm against the oblique edge 138 of the upper entraining member 132 of the blade-changing device 114.

When all the blades 21 contained in the blade-magazine 115 have been successively used and become no longer usable, during which process they circulate within the knife in the above described manner through actuation of the blade-changing device 114, the blade magazine is replaced as a whole with a new one, according to FIG. 21. To this end, the resilient latch 125 at the rear end of the knife grip 112 is pivoted somewhat sideways so that it is released from the recess 148 at the outer end edge of the blade magazine 115, whereby thereafter the blade magazine 115 may be pulled out of the knife grip in a rearward direction.

In order to render the use of the knife as simple as possible, a lock 161 is provided at the knife grip 112 at one of the longitudinal sides bordering the slot 116. This lock consists of a somewhat upstanding tongue 161 formed integrally from the plastics knife grip and is formed on injection moulding the knife grip. This lock prevents the retraction or pushing back of the blade pusher 113 to the rearmost end position in the slot 116 of the knife grip in which position a blade 21 that has been steered back from the guiding slit 120 is already laid on the entraining member 131 of the blade-changing device 114. By means of the lock 161 the blade pusher is blocked in a position in which, after finishing an operation with the knife, the blade retracted into the knife grip still has its front end in the guiding slit 120 of the knife grip, whereby the same blade may be used once again.

Only after pressing down of the lock 161 may the blade pusher 113 pushed back to the end of the slot 116 so that then the exchange for a new blade of the blade that has become no longer usable becomes possible.

What is claimed is:

1. A knife comprising a hollow knife handle, a guide slit in one end of the knife handle, a blade pusher advanceable and retractable relative to the knife-handle and arrestable in detent positions defined in the knife handle, a receptacle in the knife handle for receiving a blade magazine containing a stack of blades, a blade-changing device reciprocably movable relative to the blade magazine receptacle into and out of the knife handle, the said blade-changing device having an end projecting out from the knife handle and having its own handle for effecting its reciprocating movement, has first and second entraining members forming part of the blade-changing device and extending along a respective side of the blade magazine receptacle, the first entraining member being effective in use to retract a used blade from the said guide slit into the blade magazine while the second entraining member being effective to advance a new blade from the blade magazine to a predetermined position, said blade pusher being effective to engage said new blade at said predetermined position and push it into an operative position in the said guide slit.

2. A knife according to claim 1, wherein the first entraining member of the blade-changing device consists of two flat parallel arms which are secured at one end to a knob serving as the said handle of the device, and which extend by an amount corresponding to at least one blade length toward the said guide slit, an upstanding edge at the respective free end of each said arm for engaging a used blade lying on the arms and pulling it back into the blade magazine, and a spring supported internally in the knife handle between the arms for pressing the retracted blade against the stack of other, mutually superposed blades in the blade magazine.

3. A knife according to claim 1 wherein a flat bar arranged in parallel with the first entraining member constitutes the second entraining member and has one end thereof secured to the handle of the device, whilst its other free end is formed as a fork, each forked end having a feeding edge which in the pulled out position of the blade-changing device is disposed in front of the uppermost blade in the blade magazine, whereby on pushing the blade-changing device back into the knife handle, a new blade is fed by said feeding edges from the blade magazine towards the guide slit for entraining engagement with the blade pusher.

4. A knife according to claim 2, wherein the blade magazine has two oppositely disposed open sides, guiding edges for the lateral guidance of the said entraining members at said sides, the said guiding edges forming two abutment bars for the blades stacked in the magazine and pressed by said spring.

5. A knife according to claim 1, wherein two laterally extending support rails are disposed at the narrow side of the blade magazine facing the said guide slit, said rails providing a supported path for a new blade pushed out from the blade magazine by the second entraining member until reaching the said predetermined position.

6. A knife according to claim 1 wherein the blade pusher is guided in a slit defined in the knife handle, the blade pusher being selectably settable in detent positions within the slit, by the co-operation of detent means in the blade pusher and in the edge of the slit, a pin on the blade pusher for engagement in a hole formed in each blade for coupling the blade pusher with the blade, the blade pusher consisting of a sliding body slidably guided in the knife handle and a rocker journalled on the sliding body, detent means arranged on said rocker for setting the blade pusher in the slit of the knife handle, an arm pivotally journalled on the underside of the sliding body, the said pin being arranged at the lower end of the arm for coupling with the blade; a spring is arranged between the arm and the sliding body for automatically biasing the pin into engagement with the hole of the blade automatically, said spring pressing internally against the rocker and holding the blade-pusher in the selected detent position.

7. A knife according to claim 6, wherein said second entraining member has a feed bar with a fork-shaped free end and an inclined edge, the said arm co-operating with said inclined edge, the said spring causing said arm to abut against the said inclined edge to disengage the pin at the end of the arm from the said hole in the blade.

8. A knife according to claim 6, wherein said second entraining member has a feed bar with a fork-shaped free end and an inclined edge, a sprung tongue is formed on the outer side of the feed bar, facing the blade pusher to block the blade-changing device, the upstanding tongue engaging the edge at the end of the slit in the knife handle and being pressed down by the said sliding body in order to unblock the blade-changing device when the bladepusher is pushed back to the end of the slit in a detent position.

9. A knife according to claim 1, wherein a latch arranged at the rear of the knife handle engages in a corresponding recess at the outer end edge of the blade magazine, whereby the blade magazine is exchangeably held in the knife grip.

10. A knife according to claim 9, wherein the latch is unitary with the knife handle which is made of plastics material, said latch comprising a tongue-shaped wall part of the knife handle formed by two slits defined in the knife handle.

11. A knife according to claim 1, wherein mutually opposite support rails are rigidly arranged in the interior of the hollow knife handle and serve to support a blade to be pushed from the blade magazine to the guide slit at the front end of the knife handle, wherein underneath the support rails and in the interior of the hollow knife handle oppositely lying stationary guiding bars are arranged at an angle to the longitudinal axis of the knife and parallel, in end section, with the underside of the blade, for steering and holding down a used blade on retraction of the latter into the blade magazine and wherein a respective support rail and guiding bar are integrally moulded on the inside of the knife handle that is made from plastics material.

12. A knife according to claim 1, wherein the knife handle made from plastics material has on one side adjacent the slit for the blade pusher an integrally formed upstanding tongue serving as a lock for the rearward movement of the blade pusher by means of which the blade pusher is arrested in a position in which the blade retracted into the knife handle is disposed with its front end in the guide slit of the knife handle, and which lock can be released to push back the blade pusher to the end of the slit in order to allow a subsequent blade exchange from a used blade to a new blade.

* * * * *